US011172315B2

(12) United States Patent
Ozden

(10) Patent No.: US 11,172,315 B2
(45) Date of Patent: *Nov. 9, 2021

(54) HEARING AID HAVING COMBINED ANTENNAS

(71) Applicant: GN HEARING A/S, Ballerup (DK)

(72) Inventor: Sinasi Ozden, Rodovre (DK)

(73) Assignee: GN Hearing A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/798,224

(22) Filed: Feb. 21, 2020

(65) Prior Publication Data

US 2020/0196068 A1 Jun. 18, 2020

Related U.S. Application Data

(63) Continuation of application No. 16/446,473, filed on Jun. 19, 2019, now Pat. No. 10,667,061, which is a (Continued)

(30) Foreign Application Priority Data

Jun. 22, 2015 (DK) ..... PA 2015 70383
Jun. 22, 2015 (EP) ..... 15001843

(51) Int. Cl.
*H04R 25/02* (2006.01)
*H04R 25/00* (2006.01)

(52) U.S. Cl.
CPC ..... *H04R 25/552* (2013.01); *H04R 25/02* (2013.01); *H04R 25/505* (2013.01); (Continued)

(58) Field of Classification Search
CPC .... H04R 25/02; H04R 25/505; H04R 25/552; H04R 25/554; H04R 25/602; H04R 2225/0216; H04R 2225/51; H04R 2225/55
(Continued)

(56) References Cited

U.S. PATENT DOCUMENTS 6,021,207 A * 2/2000 Puthuff ..... H04B 1/385 379/52
6,137,889 A 10/2000 Shennib et al.
(Continued)

FOREIGN PATENT DOCUMENTS

CH 691944 A5 11/2001
CN 101438602 5/2009
(Continued)

OTHER PUBLICATIONS

"Sound and Hearing", ISBN No. 87-985233-9-2, copyright 2007.
(Continued)

*Primary Examiner* — Gerald Gauthier
(74) *Attorney, Agent, or Firm* — Vista IP Law Group, LLP

(57) ABSTRACT

A hearing aid having a hearing aid housing, includes: a microphone; a processing unit configured to process an audio signal for compensating a hearing loss of a user; a battery provided closer to a second end of the hearing aid housing than to a first end of the hearing aid housing; one or more wireless communication units for wireless communication; at least a part of a first antenna for electromagnetic field emission and/or electromagnetic field reception, the at least a part of the first antenna being interconnected with one of the one or more wireless communication units; and a second antenna for electromagnetic field emission and/or electromagnetic field reception, the second antenna being interconnected with one of the one or more wireless communication units; wherein the second antenna is between a center axis of the battery and the second end of the hearing aid.

102 Claims, 6 Drawing Sheets

Related U.S. Application Data continuation of application No. 15/564,346, filed as application No. PCT/EP2016/064415 on Jun. 22, 2016, now Pat. No. 10,362,410.

(52) U.S. Cl.
CPC ..... *H04R 25/554* (2013.01); *H04R 25/602* (2013.01); *H04R 2225/0216* (2019.05); *H04R 2225/51* (2013.01); *H04R 2225/55* (2013.01)

(58) Field of Classification Search
USPC ..... 381/23.1, 74, 315, 312, 322, 330; 455/90.3
See application file for complete search history.

(56) References Cited

U.S. PATENT DOCUMENTS

| | | | | |
|---|---|---|---|---|
| 6,438,245 | B1 * | 8/2002 | Taenzer | H04M 1/05 381/322 |
| 8,145,144 | B2 * | 3/2012 | Krenz | H04M 1/72478 455/90.3 |
| 8,344,689 | B2 | 1/2013 | Boguslavskij | |
| 8,363,872 | B2 | 1/2013 | Wiggins et al. | |
| 8,644,542 | B2 | 2/2014 | Klemenz et al. | |
| 8,649,541 | B2 | 2/2014 | Newton et al. | |
| 8,867,765 | B2 * | 10/2014 | Solum | H04R 25/554 381/315 |
| 8,891,793 | B1 * | 11/2014 | Sacha | H04R 25/558 381/315 |
| 9,060,234 | B2 | 6/2015 | Wagner et al. | |
| 9,236,756 | B2 | 1/2016 | Jenwatanavet et al. | |
| 9,277,332 | B2 | 3/2016 | Ku et al. | |
| 9,319,808 | B2 | 4/2016 | Ruaro | |
| 9,521,494 | B2 | 12/2016 | Nikles | |
| 9,628,922 | B2 | 4/2017 | Rasmussen et al. | |
| 9,661,426 | B2 * | 5/2017 | Ozden | H04R 25/554 |
| 10,218,223 | B2 | 2/2019 | Hatanaka et al. | |
| 10,362,410 | B2 | 7/2019 | Ozden | |
| 10,667,061 | B2 * | 5/2020 | Ozden | H04R 25/552 |
| 2002/0030630 | A1 | 3/2002 | Maeda et al. | |
| 2004/0196996 | A1 * | 10/2004 | Feitel | H04R 25/65 381/322 |
| 2005/0100182 | A1 * | 5/2005 | Sykes | G09B 21/009 381/315 |
| 2006/0039577 | A1 | 2/2006 | Sanguino et al. | |
| 2007/0003088 | A1 * | 1/2007 | Lehtola | H04M 1/72478 381/330 |
| 2007/0291971 | A1 * | 12/2007 | Halteren | H04R 25/48 381/322 |
| 2008/0205678 | A1 * | 8/2008 | Boguslavskij | H02J 7/025 381/312 |
| 2009/0046879 | A1 * | 2/2009 | Knudsen | H01Q 7/08 381/315 |
| 2009/0196444 | A1 * | 8/2009 | Solum | H01Q 1/241 381/315 |
| 2009/0196449 | A1 * | 8/2009 | Platz | H01Q 7/00 381/330 |
| 2009/0285426 | A1 | 11/2009 | Boguslayskij | |
| 2009/0315787 | A1 | 12/2009 | Schatzle | |
| 2010/0054513 | A1 | 3/2010 | Bally et al. | |
| 2010/0067707 | A1 * | 3/2010 | Schwerdtner | H04R 25/552 381/23.1 |
| 2010/0226518 | A1 * | 9/2010 | Severin | H04R 25/604 381/322 |
| 2011/0059696 | A1 | 3/2011 | Rasmussen et al. | |
| 2011/0194717 | A1 | 8/2011 | Hansen et al. | |
| 2012/0087506 | A1 | 4/2012 | Ozden | |
| 2012/0093324 | A1 * | 4/2012 | Sinasi | H04R 25/552 381/23.1 |
| 2013/0188803 | A1 * | 7/2013 | Shaanan | H04R 1/10 381/74 |
| 2013/0343584 | A1 * | 12/2013 | Bennett | H04R 25/554 381/315 |
| 2014/0010392 | A1 | 1/2014 | Kvist | |
| 2014/0185848 | A1 * | 7/2014 | Ozden | H04R 25/554 381/315 |
| 2014/0314264 | A1 * | 10/2014 | Meskens | A61N 1/36036 381/330 |
| 2015/0078599 | A1 * | 3/2015 | Sundberg | H04R 25/402 381/315 |
| 2015/0124976 | A1 * | 5/2015 | Pedersen | A61N 1/37252 381/23.1 |
| 2015/0208180 | A1 * | 7/2015 | Martius | H02J 50/40 381/315 |
| 2015/0230036 | A1 * | 8/2015 | Pedersen | H04R 25/305 381/330 |
| 2015/0289067 | A1 | 10/2015 | Riepenhoff | |
| 2016/0373867 | A1 | 12/2016 | Ozden | |

FOREIGN PATENT DOCUMENTS

| | | | |
|---|---|---|---|
| CN | 102017779 | | 4/2011 |
| CN | 103905965 | | 7/2014 |
| CN | 104640040 | | 5/2015 |
| EP | 1973379 | | 9/2008 |
| EP | 2 076 065 | A1 | 7/2009 |
| EP | 2076065 | | 7/2009 |
| EP | 2403273 | | 1/2012 |
| EP | 2498514 | | 9/2012 |
| EP | 2 546 926 | A1 | 1/2013 |
| EP | 2546926 | | 1/2013 |
| EP | 2793487 | | 10/2014 |
| EP | 2 942 878 | A1 | 11/2015 |
| EP | 2942878 | | 11/2015 |
| WO | WO 2005/081583 | | 9/2005 |
| WO | WO 2005/081583 | A1 | 9/2005 |
| WO | WO 2008/012355 | | 1/2008 |
| WO | WO 2008/012355 | A1 | 1/2008 |
| WO | WO 2008/113053 | | 9/2008 |
| WO | WO 2012/092973 | | 7/2012 |
| WO | WO 2012/092973 | A1 | 7/2012 |
| WO | WO 2014/086392 | | 6/2014 |
| WO | WO 2014/086392 | A1 | 6/2014 |

OTHER PUBLICATIONS

"IEEE Standard Definitions of Terms for Antennas", Institute of Electrical and Electronics Engineers, Inc., ISBN 1-55937-317-2, Published 1993.

Dillon, H. "Hearing Aids,", Boomerang Press, Copyright 2012.

Translation of Search Report for Chinese Patent Application No. 201680036729.1, which corresponds with the subject U.S. application.

Translation of Supplemental Search Report for Chinese Patent Application No. 201680036729.1, which corresponds with the subject U.S. application.

Non-Final Office Action for U.S. Appl. No. 16/446,473 dated Sep. 6, 2019.

Amendment Response for NFOA for U.S. Appl. No. 16/446,473 dated Dec. 6, 2019.

Notice of Allowance for U.S. Appl. No. 16/446,473 dated Jan. 21, 2020.

International Search Report and Written Opinion dated Jul. 29, 2016 for corresponding PCT Application No. PCT/EP2016/064415.

Extended European Search Report dated Nov. 26, 2015 for corresponding EP Patent Application No. 15001843.0, 8 pages.

First Technical Examination and Search Report dated Jan. 12, 2016 for corresponding Danish Patent Application No. PA 201570383,7 pages.

Notice of Allowance and Fee(s) dated Jan. 20, 2017 for related U.S. Appl. No. 14/789,494.

Non-Final Office Action dated Jun. 15, 2018 for related U.S. Appl. No. 15/564,346.

Final Office Action dated Nov. 19, 2018 for related U.S. Appl. No. 15/564,346.

Notice of Allowance and Fee(s) dated Mar. 6, 2019 for related US, U.S. Appl. No. 15/564,346.

(56) References Cited

OTHER PUBLICATIONS

Amendment After NFOA for U.S. Appl. No. 15/564,346 dated Sep. 17, 2018.
Amendment After Final for U.S. Appl. No. 15/564,346 dated Mar. 6, 2019.

* cited by examiner

HEARING AID HAVING COMBINED ANTENNAS

RELATED APPLICATION DATA

This application is a continuation of U.S. patent application Ser. No. 16/446,473 filed on Jun. 19, 2019, now U.S. Pat. No. 10,667,061, which is a continuation of U.S. patent application Ser. No. 15/564,346 filed on Oct. 4, 2017, now U.S. Pat. No. 10,362,410, which is the national stage of International Patent Application No. PCT/EP2016/064415, filed on Jun. 22, 2016, which claims priority to and the benefit of Danish Patent Application No. PA 2015 70383 filed on Jun. 22, 2015, and European Patent Application No. 15001843.0 filed on Jun. 22, 2015. The entire disclosures of all of the above applications are expressly incorporated by reference herein.

TECHNICAL FIELD

The present disclosure relates to antennas for hearing aids, in particular the present disclosure relates to hearing aids having two or more antennas, such as for example to a hearing aid having a combination of an electrical antenna and a magnetic antenna. The hearing aid may be used in a binaural hearing aid system. During operation, the hearing aid is worn at the ear of a user.

BACKGROUND

Hearing aids are very small and delicate devices and comprise many electronic and metallic components contained in a housing small enough to fit in the ear canal of a human or be located behind the outer ear. The many electronic and metallic components in combination with the small size of the hearing aid housing impose high design constraints on radio frequency antennas to be used in hearing aids with wireless communication capabilities.

Moreover, the antenna in the hearing aid has to be designed to achieve a satisfactory performance despite these limitations and other high design constraints imposed by the size of the hearing aid.

Still further, in binaural hearing aid systems, the requirements to the quality of the communication between the hearing aids in the binaural hearing aid system are ever increasing, and include demands for low latency and low noise, increasing the requests for effective antennas in the hearing aids.

SUMMARY

It is an object to provide a hearing aid with improved wireless communication capabilities, such as improved wireless communication capabilities between two hearing aids worn at opposite ears of the user, and/or between a hearing aid and an accessory device.

In accordance with some embodiments, the above-mentioned and other objects are obtained by a hearing aid, the hearing aid having a hearing aid housing, the hearing aid housing having a first end and a second end and comprising a microphone configured to receive an audio signal, a processing unit configured to process the audio signal for compensating a hearing loss of a user, a speaker for providing the processed audio signal to the user, a battery, one or more wireless communication units for wireless communication, a first antenna for emission and/or reception of an electromagnetic field being interconnected with one of the one or more wireless communication units, and a second antenna for emission and/or reception of an electromagnetic field being interconnected with one of the one or more wireless communication units.

The battery may be provided closer to a second end of the hearing aid than to a first end of the hearing aid, and the second antenna may be provided between the battery, such as between a center axis of the battery, and the second end of the hearing aid. The first antenna may be provided between the battery, such as between the center axis of the battery, and the first end of the hearing.

It is an advantage of the hearing aid that a first antenna and a second antenna are provided in the hearing aid, increasing the wireless communication capabilities of the hearing aid.

According to a further aspect, a binaural hearing aid system is disclosed, the binaural hearing aid system comprising a first and a second hearing aid to be provided at a first and a second ear of the user, respectively, and wherein one or both of the hearing aids is a hearing aid as herein disclosed.

The first antenna may be configured for radiation in a first frequency range, and the second antenna may be configured for radiation in a second frequency range.

The first antenna may be provided on a first side of the battery and the second antenna may be provided on a second side of the battery, the first side of the battery and the second side of the battery may be opposite sides of the battery, either transversely or longitudinally. The first antenna may be provided between the battery and the first end of the hearing aid.

In one or more embodiments, the hearing aid comprises hearing aid electronic components including the signal processor. The hearing aid electronic components may be provided on a printed circuit board, and typically, the hearing aid electronic components are provided on the first side of the battery, such as between the battery and the first end of the hearing aid. Hereby, the battery provides shielding for the second antenna with respect to any noise caused by the first antenna and/or the hearing aid electronic components. Thus, the battery may act as a shielding element for the second antenna.

The hearing aid may be any hearing aid, such as a hearing aid of the in-the-ear type, such as in-the-canal type, such as completely-in-the-canal type of hearing aid, etc., a hearing aid of the behind-the-ear type, of the receiver-in-the-ear type of hearing aid, etc.

Typically, the hearing aid comprises a hearing aid part configured to be positioned behind the ear of a user and a coupling element for coupling sound or audio to the ear of a user.

In one or more embodiments, the hearing aid comprises a first hearing aid part configured to be positioned behind the ear of a user, a second hearing aid part being configured to be positioned in the ear of a user, and a coupling element coupling the first hearing aid part and the second hearing aid part. The first hearing aid part may comprise the battery, and the second hearing aid part may comprise the speaker. Typically, the first hearing aid part comprises at least the microphone, the processing unit configured to process the audio signal for compensating a hearing loss of a user and the battery, whereas the speaker may be provided in the second hearing aid part. Typically, also the one or more wireless communication units are provided in the first hearing aid part. The first hearing aid part may be provided in a first hearing aid housing, and the second hearing aid part may be provided in a second hearing aid housing. Such hearing aids are typically referred to as receiver-in-the-ear hearing aids or RIE hearing aids.

In one or more embodiments, the hearing aid comprises a first hearing aid part configured to be positioned behind the ear of a user and a coupling element, coupling the first hearing aid part and the ear canal of a user. Such hearing aids are typically referred to as behind-the-ear hearing aids, or BTE hearing aids.

The coupling element may provide a processed sound to the ear, or the ear canal, of a user. The coupling element may comprise an electrical connection to a second hearing aid part comprising a speaker or a receiver for receiving processed audio signals from the signal processor provided in the first hearing aid part. The coupling element may comprise a sound tube or a thin tube for providing processed sound to the ear. The coupling element may comprise an ear hook for providing the processed sound to the ear of a user.

In one or more embodiments, the coupling element may comprise at least a part of the first antenna. Thus, the first antenna may have at least a part of the antenna extending in the coupling element, and the antenna may have another part in the first hearing aid part and/or a further part in the second hearing aid part.

In some embodiments however, the first antenna and the second antenna are provided within the first hearing aid part, such as within the first hearing
aid housing. In other embodiments, the first antenna may protrude into the coupling element.

A hearing aid housing, such as the first and/or second hearing aid housing, may comprise a hearing aid assembly, comprising components of the hearing aid, the hearing aid assembly being provided in the hearing aid housing. The hearing aid housing typically comprises a shell, such as a polymer or plastic shell, in a shape configured to be provided in the ear, in the ear-canal or behind the ear of a user. The coupling element is typically attachable to the hearing aid housing.

The one or more wireless communications unit(s) are configured for wireless data communication, and in this respect interconnected with the first and/or second antenna for emission and reception of an electromagnetic field. Each of the one or more wireless communication unit may comprise a transmitter, a receiver, a transmitter-receiver pair, such as a transceiver, a radio unit, etc. The one or more wireless communication units may be configured for communication using any protocol as known for a person skilled in the art, including Bluetooth, WLAN standards, manufacture specific protocols, such as tailored proximity antenna protocols, such as proprietary protocols, such as low-power wireless communication protocols, RF communication protocols, magnetic induction protocols, etc. The one or more wireless communication units may be configured for communication using same communication protocols, or same type of communication protocols, or the one or more wireless communication units may be configured for communication using different communication protocols.

In one or more embodiments, the first antenna has a longitudinal extension in a first direction. Thus, the first antenna may have an overall longitudinal extension in a first direction. The direction may indicate a line or path along which the first antenna is extending. For example, the overall length of the first antenna may be larger than the overall width of the first antenna indicating a longitudinal extension in the lengthwise direction.

The first antenna may extend in one or more primary planes, such as extend substantially in a primary plane, such that for example at least 95%, 90%, 85% or 80% of the first antenna extends in one or more of the primary planes. The one or more primary planes may be parallel primary planes.

Thus, for example, the first antenna may comprise a first antenna element extending along a first side of the hearing aid housing and a second antenna element extending along a second side of the hearing aid housing.

The first side of the hearing aid housing may be a first longitudinal side of the hearing aid housing, and the second side of the hearing aid housing may be a second longitudinal side of the hearing aid housing. The first side may be opposite the second side.

In one or more embodiments, the second antenna may have a longitudinal extension in a second direction, the second direction being parallel to, or being 0/180 degrees+/−35 degrees, to an ear-to-ear axis of a user, when the hearing aid is worn in its operational position during use.

The second direction may be orthogonal, such as 90 degrees+/−35 degrees, to at least one of the primary planes, such as orthogonal, such as 90 degrees+/−35 degrees, to one or more parallel primary planes.

In one or more embodiments, the second direction is a direction which is 90 degrees+/−35 degrees with respect to a side of the hearing aid, wherein the side is adjacent a head of a user during use.

Thus, for example, the first antenna may substantially extend in a primary plane, whereas the second antenna may extend in a second direction being orthogonal to the primary plane.

The first antenna may have a longitudinal extension in a first direction, whereas the second antenna may extend in a second direction being orthogonal to the first direction.

In one or more embodiments, the first antenna is configured to have a first radiation pattern and the second antenna is configured to have a second radiation pattern, the first radiation pattern being different from the second radiation pattern.

The near field pattern for the first and/or the second antenna may be a TM polarized near field. The first and/or second radiation pattern may be dominated by the E-field, so that a primary part of the overall electromagnetic field, such as more than 75%, such as more than 80%, such as more than 85%, such as more than 90% of the overall electromagnetic field, is contributed by the E-field.

An advantage of the hearing aids as disclosed herein is that an improved wireless ear-to-ear communication may be achieved for most head sizes, shapes and amount of hair may be provided. Human heads and human ears vary in size and shape and also the amount of hair varies from person to person, and thus. Hearing aids adapted for wireless communications may be susceptible to impairments of for example the ear-to-ear communication due to e.g. the head of the user. Radio waves from a hearing aid at one side may have to travel through or around the head in order to reach the hearing aid at the other ear. Therefore, the human head may be perceived as an obstacle to the ear-to-ear communication. It is an advantage that the antennas as provided in the hearing aids improve the ear-to-ear communication.

In one or more embodiments, the first antenna is configured to operate in a first frequency range, and the second antenna is configured to operate in a second frequency range. The first frequency range may comprise higher frequencies than the second frequency range.

The first antenna may be an electric antenna, and the second antenna may be a magnetic antenna.

The first antenna may be configured to operate in a first frequency range, such as at a frequency above 800 MHz, such as at a frequency above 1 GHz, such as at a frequency of 2.4 GHz, such as at a frequency between 1.5 GHz and 3 GHz, during use. Thus, the first antenna may be configured for operation in ISM frequency band. The first antenna may be any antenna capable of operating at these frequencies, and the first antenna may be a resonant antenna, such as monopole antenna, such as a dipole antenna, etc. The resonant antenna may have a length of lambda/4 or any multiple thereof, lambda being the wavelength corresponding to the emitted electromagnetic field.

The second antenna may be configured to operate at a second frequency range, such as at a frequency below 100 MHz, such as at below 30 MHz, such as below 15 MHz, during use. The second antenna may be configured to operate at a frequency range between 1 MHz and 100 MHz, such as between 1 MHz and 15 MHz, such as between 1 MHz and 30 MHz, such as between 5 MHz and 30 MHz, such as between 5 MHz and 15 MHz, such as between 10 MHz and 11 MHz, such as between 10.2 MHz and 11 MHz.

Especially, for a second antenna operating at a frequency below 10 MHz or below 100 MHz, is it advantageous that the battery is provided between the second antenna and the hearing aid electronic components, as the second antenna operating at such frequencies could be susceptible to noise originating from the hearing aid electronic components.

In present day communication systems, numerous different communication systems communicate at or about 2.4 GHz, and thus there is also a significant noise in the frequency range at or about 2.4 GHz. It is an advantage that for some applications for which the noise may be acceptable, for example for data communication, a first antenna, such as a first electrical antenna may be used. For other applications, in which a high noise level may impact the transmission significantly, a second antenna, such as a magnetic antenna may be used. For example, the second antenna may be used for streaming of audio.

In one or more embodiments, the first antenna is configured for data communication at a first bit rate. In one or more embodiments, the second antenna is configured for data communication at a second bit rate, the second bit rate being larger than the first bit rate, such as by a factor 10, such as by a factor 30, a factor 50, a factor 100, etc.

The second antenna may be configured for communication using magnetic induction. It is an advantage of using magnetic induction that typically low latency may be obtained. Especially when streaming audio is it of importance to keep the latency low, to avoid delays noticeable by a user. Typically, a delay of less than 100 ms, such as of less than 50 ms, such as of less than 25 ms, such as of less than 10 ms, such as of less than 5 ms, such as of less than 1 ms, is preferred.

It is a further advantage of using magnetic induction for example for communicating between a first hearing aid and a second hearing aid in a binaural system that for the low frequencies, i.e. typically below 100 MHz, and corresponding long wavelengths, the head is not considered as a significant obstacle for the electromagnetic radiation emitted by the second antenna, thus, the reduction of electromagnetic radiation due to tissue absorption is reduced when the frequency is reduced.

In the following the embodiments are described primarily with reference to a hearing aid, such as a binaural hearing aid. It is however envisaged that the disclosed features and embodiments may be used in combination with any aspect of the embodiments.

BRIEF DESCRIPTION OF THE DRAWING

The above and other features and advantages will become more apparent to those of ordinary skill in the art by describing in detail exemplary embodiments thereof with reference to the attached drawings in which.

DETAILED DESCRIPTION

The embodiments will now be described more fully hereinafter with reference to the accompanying drawings. The claimed invention may, however, be embodied in different forms and should not be construed as limited to the embodiments set forth herein.

As used herein, the term "antenna" refers to an electrical or magnetic device which converts electric or magnetic power into radio waves. An electric antenna may comprise an electrically conductive material connected to e.g. a wireless communications unit, such as a radio chip, a receiver or a transmitter. A magnetic antenna, such as a magnetic loop antenna, may comprise a coil of electrically conductive material wound around a core of magnetic material.

Figure 1:
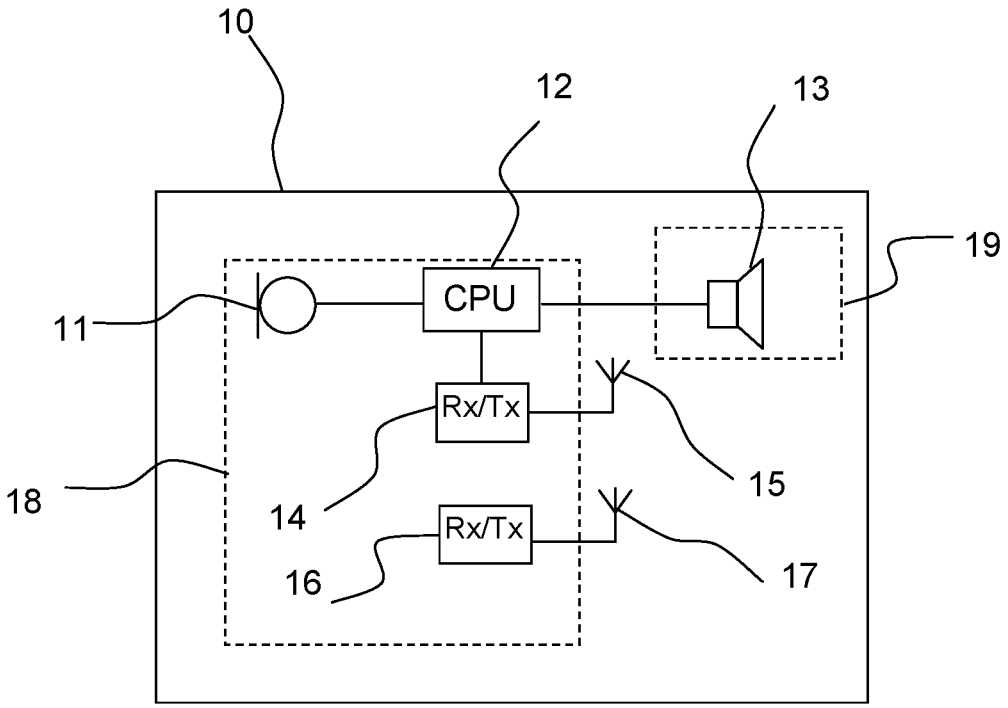
FIG. 1 shows a schematic view of a hearing aid according to an embodiment of the disclosure.

FIG. 1 shows a block-diagram of a hearing aid. In FIG. 1, the hearing aid 10 comprises a microphone 11 for receiving incoming sound and converting it into an audio signal, i.e. a first audio signal. The first audio signal is provided to a signal processor 12 for processing the first audio signal into a second audio signal compensating a hearing loss of a user of the hearing aid. A receiver 13 is connected to an output of the signal processor 12 for converting the second audio signal into an output sound signal, e.g. a signal modified to compensate for a users hearing impairment, and provides the output sound to a speaker 13. Thus, the hearing instrument signal processor 12 may comprise elements such as amplifiers, compressors and noise reduction systems etc. The hearing aid may further have a feedback loop for optimizing the output signal. The hearing aid has one or more wireless communication units 14, 16 (e.g. a transceiver) for wireless communication, each interconnected with an antenna 15, 17 for emission and reception of an electromagnetic field. The wireless communication units 14, 16 may connect to the hearing aid signal processor 12 and antennas 15, 17 for communicating with external devices, or with another hearing aid, located at another ear, in a binaural hearing aid system. The signal processor 12, the one or more wireless communication units 14, 16, and the antennas 15, 17 may be provided in a hearing aid housing 18. In some embodiments, the speaker 13 is provided in the first hearing aid part in the hearing aid housing 18, such as in behind-the-ear (BTE) hearing aids. In other embodiments, the speaker 13 is provided in a second hearing aid part 19, and for example provided in the ear of a user, such as in receiver-in-the-ear (RIE) hearing aids.

Figure 2:
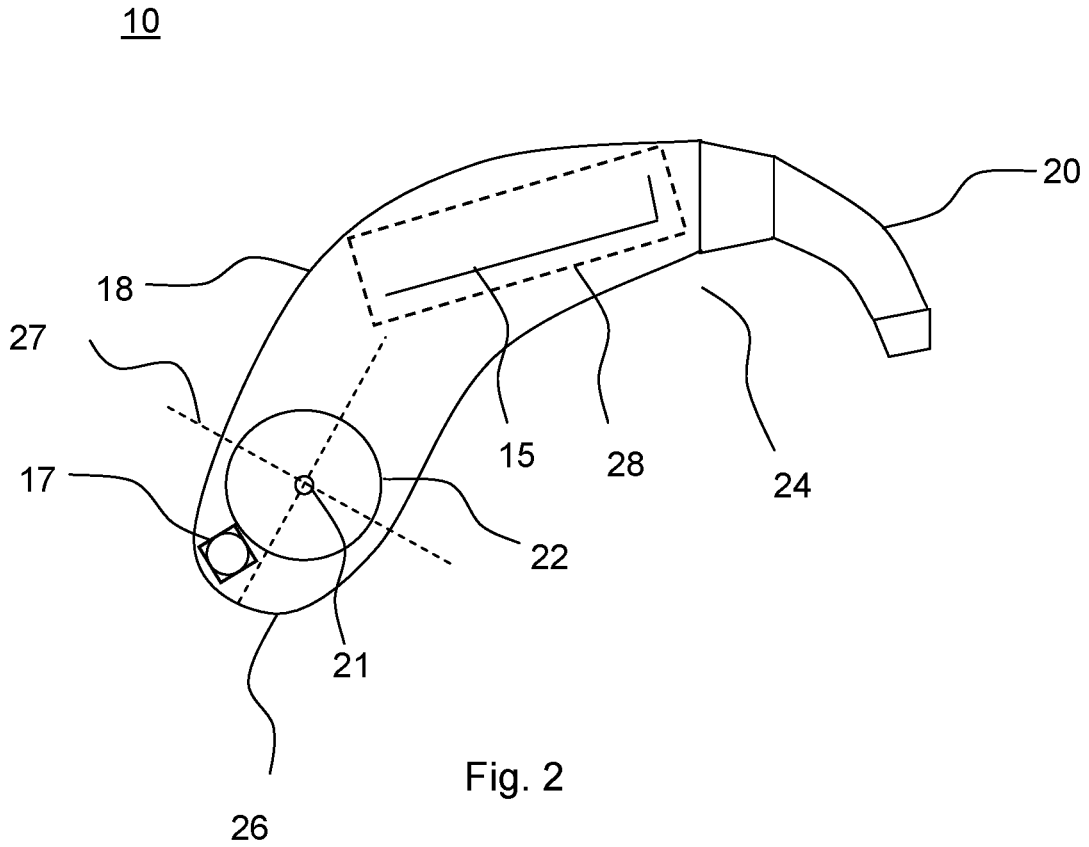
FIG. 2 shows a BTE hearing aid with an ear hook according to the present disclosure.

In FIG. 2, a hearing aid 10 is shown, the hearing aid 10 being configured to be positioned behind the ear of a user during use. The hearing aid 10 is a behind-the-ear hearing aid. The hearing aid 10 comprises a hearing aid housing 18 and a coupling element 20. In FIG. 2, the speaker 13 (not shown in FIG. 2) is positioned in the hearing aid housing 18, and the coupling element 20 couples the sound to the ear of a user. The hearing aid further comprises a battery 22 for supplying power to the electronic components, including the one or more wireless communication units 14, 16, the signal processor 12, etc., of the hearing aid. It is seen that the battery 22 is provided closer to a second end 26 of the hearing aid housing 18 than to a first end 24 of the hearing aid housing 18. The hearing aid furthermore comprises a first antenna 15 and a second antenna 17.

In FIG. 2, the first antenna 15 is provided within the hearing aid housing 18. It is however envisaged that the first antenna in some embodiments may extend into the coupling element 20. The first antenna 15 is an electric antenna, such as a monopole or dipole electric antenna. The first antenna 15 may be provided on a printed circuit board 28, and the printed circuit board 28 may be a flexible printed circuit board 28. Further electronic components may be provided on the printed circuit board 28.

The second antenna 17 is provided or positioned between the battery and a second end, such as between a center axis 21 of the battery 22 and the second end 26 of the hearing aid. Typically, the second antenna 17 is a magnetic antenna for establishing an inductive connection, and the second antenna may be a loop antenna, such as a magnetic loop antenna, a coil antenna, etc.

In some embodiments, the battery is a round flat type battery, such as a button cell type battery or coin cell type battery, and the center axis of the battery is an axis through a center of the battery from a first flat side of the battery to the other flat side of the battery. In some embodiments, a further battery axis 27 is defined as an axis through the center of the battery and a point on the circumference of the battery, the further battery axis being orthogonal, such as 90 degrees+/−15 degrees, such as 90 degrees+/−35 degrees, to a top side and/or a bottom side of the hearing aid housing 18 at the position of the center of the battery.

The battery may be a round flat battery, such as a coin cell type battery type, and the battery may be provided with the flat sides along longitudinal axes of the hearing aid housing 18, such as along the longitudinal axes of the first hearing aid part 33.

The second antenna 17 may be provided so that both the center axis 21 of the battery and the further battery axis 27 is on one side of the second antenna 17, and the second end 26 of the hearing aid housing 33, i.e. the first part of the hearing aid housing 33, is on another side of the second antenna 17. Thus, the second antenna 17 may be positioned between a center plane of the battery, the center plane being established by the center axis 21 of the battery and the further battery axis 27, and the second end 26 of the hearing aid housing 33.

It has been found that hereby, a shadow effect of the battery reduces interference between the first antenna 15 and the second antenna 17.

Figure 3:
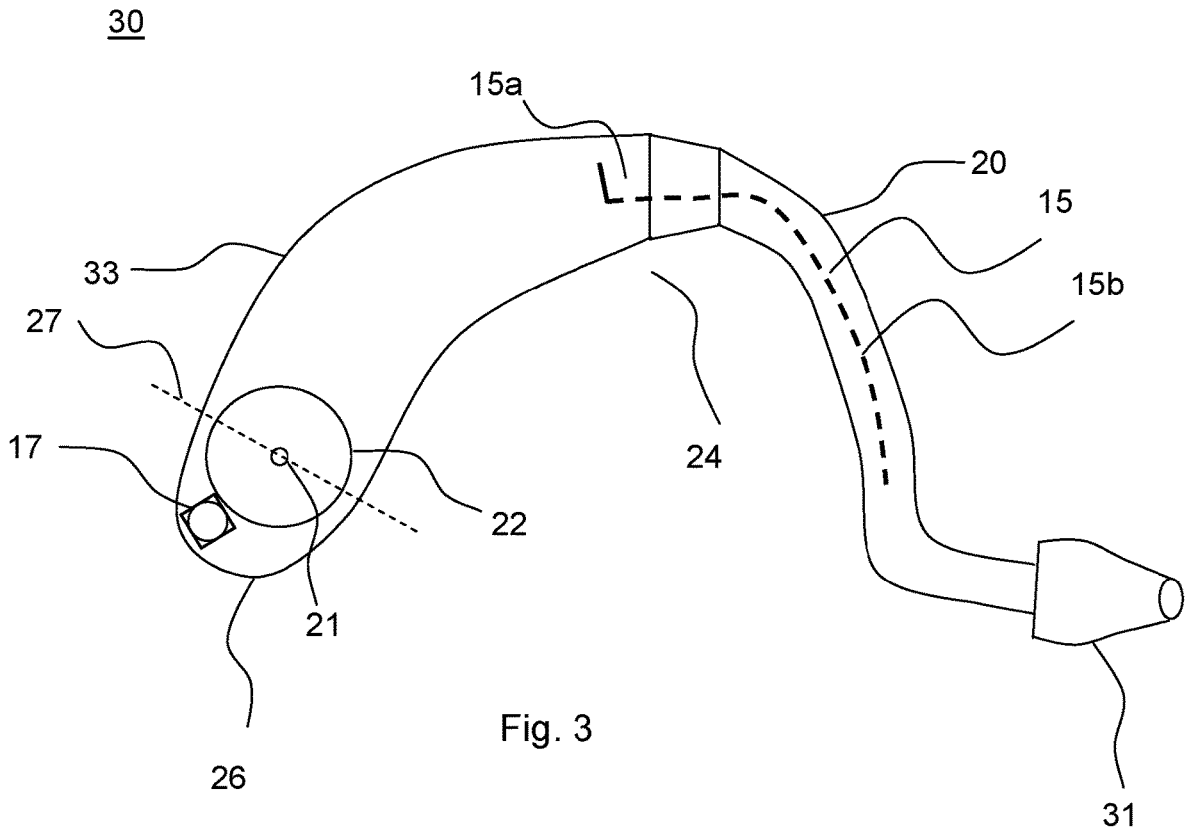
FIG. 3 shows a RIE hearing aid according to the present disclosure.

In FIG. 3, another hearing aid 30 is shown. In FIG. 3, like numerals represents the same elements as shown in FIG. 2. However, in FIG. 3, the hearing aid is a hearing aid having a first hearing aid part 33 being configured to be positioned behind the ear of a user, and a second hearing aid part 31 being configured to be positioned in the ear canal of a user. A coupling element 20 connects the first hearing aid part 33' and the second hearing aid part 31. The hearing aid part 31 is shown as provided in housing or shell 31. In FIG. 3, a first part 15*a* of the first antenna 15 is provided in the first hearing aid part 33, and thus in the first hearing aid housing 33, while another part 15*b* of the first antenna 15 is provided in the coupling element 20. The first part 15*a* of the first antenna 15 is connected to a first wireless communication unit, such as a transceiver (not shown in FIG. 3) in the first hearing aid part 33.

The second antenna 17 is typically connected to a second wireless communication unit, such as a transceiver, different from the first wireless communication unit.

Figure 4A:
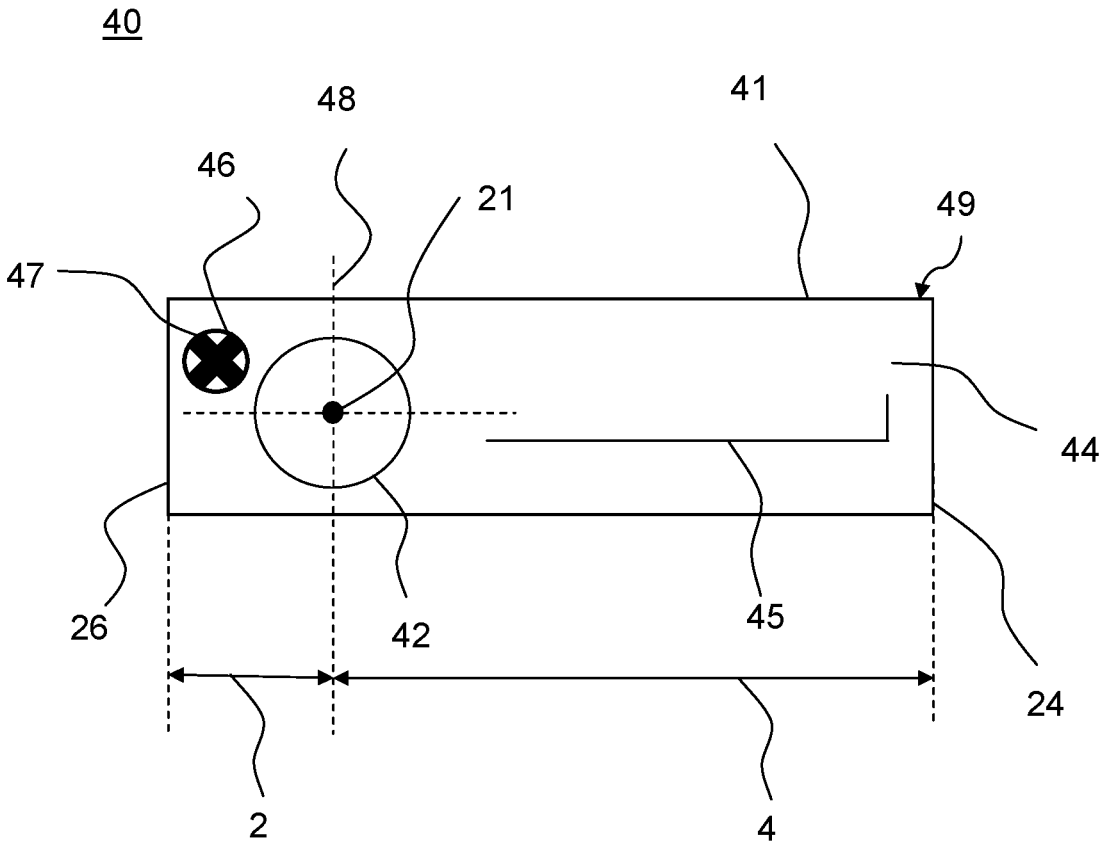
FIGS. 4*a* and 4*b* show schematically components of a hearing aid according to the present disclosure.
Figure 4B:
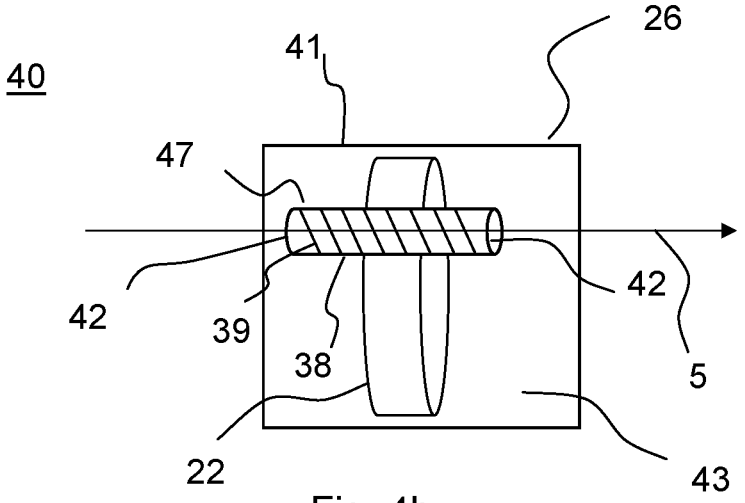

FIGS. 4*a* and 4*b* show schematically a hearing aid according to the present disclosure. FIG. 4*a* shows a side view of a hearing aid, such as of a first part 41 of a hearing aid 40. The first part of the hearing aid, i.e. the first hearing aid housing or part 41, has a longitudinal side 44 and a top side 49. The first hearing aid part 41 has a first end 24 and a second end 26. The hearing aid 40 has a battery 42, a first antenna 45 and a second antenna 47. It is seen that the battery is provided in the first hearing aid part 41 closer to the second end 26 of the first part 41 of the hearing aid, than to the first end 26 of the first hearing aid part 41. Thus, a first distance 2 from the second end 26 to the center axis 43 of the battery is smaller than a second distance 4 from the first end 24 to the center axis 43 of the battery.

The first antenna 45 extends along a side, such as a longitudinal side 44, of the first hearing aid part, or hearing aid housing, 41. The second antenna 47 is a magnetic loop antenna which has a longitudinal axis 46 out of the plane of the paper. It is seen that the center axis 43 of the battery 42 is out of the plane of the paper and thus parallel, such as parallel +/−15 degrees, such as parallel +/−35 degrees, with the longitudinal axis 46 of the magnetic loop antenna 47.

The further battery axis 48 is seen as being orthogonal to the top side 49 of the first hearing aid housing 41, such as having an angle of 90 degrees+/−15 degrees, such as 90 degrees+/−35 degrees, to a top side and/or a bottom side of the hearing aid housing 41 at the position of the center of the battery.

In FIG. 4*b*, the hearing aid 40 is seen from an end view, from the second end 26 of the first hearing aid housing 41. The hearing aid housing 41 has an end side 43 of the housing or shell of the hearing aid housing 41. The battery 22 is seen to be positioned closer to the second end 26 than to the first end (not shown in FIG. 4*b*) and the second antenna 47 is positioned between the second end 26 and the battery 22. Typically, the second antenna 47 comprises a magnetic core 38, in the form of a rod of a magnetic material, and windings 39 of an electrical conductor wound around the magnetic core 38. The magnetic core has a longitudinal axis 5.

The second antenna 47 may be provided so that the rod 38 of magnetic material is provided transversal in the first hearing aid housing 41, thus so that the second antenna has a longitudinal direction orthogonal to longitudinal sides 44 of the first hearing aid housing. The longitudinal axis 5 may thus form an angle with the longitudinal sides of the first hearing aid housing of 90 degrees, such as of 90 degrees+/−15 degrees, such as of 90 degrees+/−35 degrees. The second antenna 47 may primarily radiate through end surfaces 42. The magnetic core 38 and the windings 39 may be provided in a housing (not shown), such as a housing shielding longitudinal parts of the second antenna 47.

Figure 5:
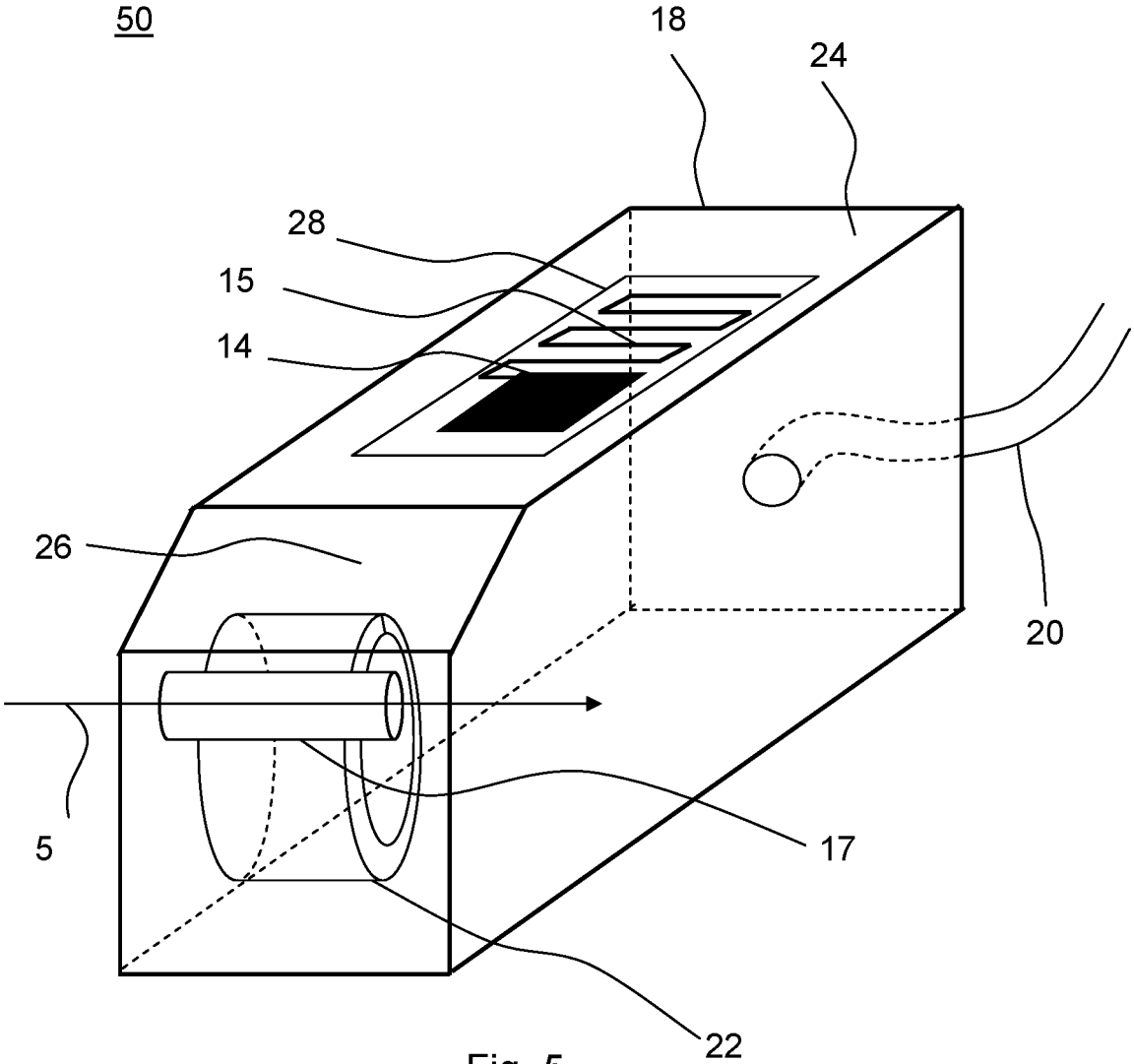
FIG. 5 shows a three dimensional illustration of a hearing aid according to the present disclosure.

FIG. 5 shows schematically a 3-dimensional hearing aid. The first antenna 15 is provided on a PCB 28 in the top of a first hearing aid housing 18. The first antenna is connected to a transceiver or radio 14. The battery 22 is provided closer to the second end 26 of the hearing aid housing 18 than to the first end of the hearing aid housing 24. It is seen that the second antenna 17 is provided behind the battery with respect to the first antenna 15, and thus between the battery 22 and the second end 26 of the hearing aid housing. Coupling element 20 connects the hearing aid housing 18 to the ear of the user (not shown), either by coupling sound through a coupling element in the form of an ear hook or a sound tube, or by coupling a signal to a receiver as positioned in the ear of a user via a coupling element 20 comprising an electrical signal path.

Figure 6:
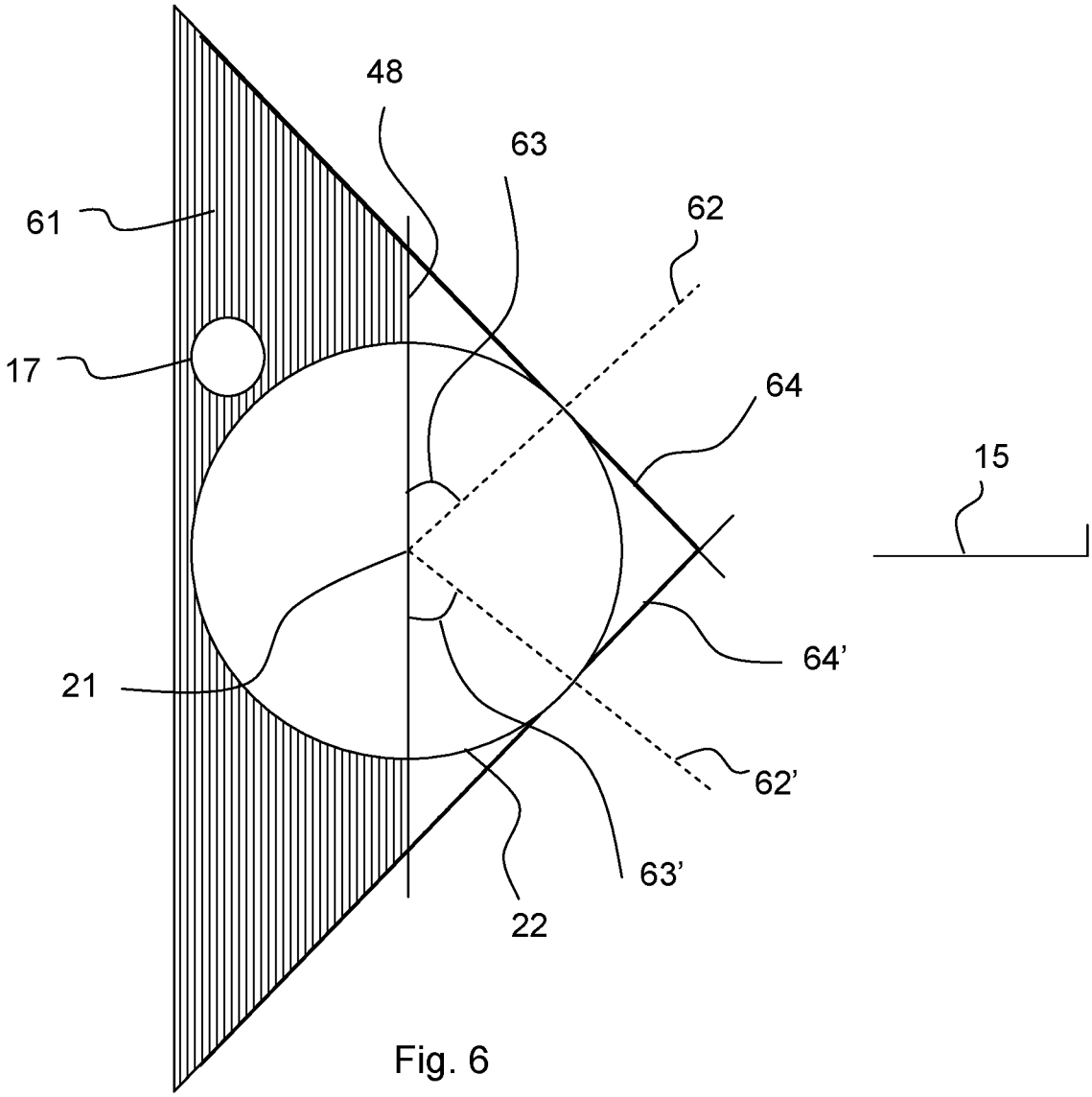
FIG. 6 illustrates a shadow effect of the battery.

FIG. 6 shows schematically a shadow effect of the battery as provided in the first hearing aid part, such as in the first hearing aid housing. In FIG. 6, the battery 22 is shown having a center axis 21 out of the plane of the paper and a further battery axis 48, as previously described. At one side of the battery, an antenna will be shielded by the battery from influence from an antenna at the other side of the battery. Thus, if the second antenna 17 is provided behind the battery 22, for example in the shadow region 61, the second antenna 17 is shielded from the first antenna 15 by the battery 22.

The shadow region 61 behind the battery may be defined as the region behind the center axis 21 of the battery 22, and more specifically, the shadow region may be defined as being the region behind the plane defined by the center axis 21 and the further battery axis 48. The shadow region 61 may be still further specified. Thus, an axis 62, 62' may be defined as an axis having an angle 63 to the further battery axis 48 towards the first antenna 15, the angle 63 being between 0 and 45 degrees. At the intersection between the axis 62, 62' and the circumference of the battery, a tangent is provided, and the shadow region is defined by the plane defined by the center axis 21 and the further battery axis 48, and furthermore, by the plane of the tangents 64, 64'. A second antenna 17 provided in the shadow region 61 may thus be shielded with respect to the antenna 15 provided at the other side of the battery, opposite the shadow region 61.

One or more feature(s) described herein may be implemented or incorporated into the following items:

Item 1: A hearing aid having a hearing aid housing, the hearing aid housing having a first end and a second end and comprising: a microphone configured to receive an audio signal, a processing unit configured to process the audio signal for compensating a hearing loss of a user, a battery provided closer to a second end of the hearing aid housing than to a first end of the hearing aid housing, one or more wireless communication units for wireless communication, at least a part of a first antenna for emission and/or reception of an electromagnetic field being interconnected with one of the one or more wireless communication units, and a second antenna for emission and/or reception of an electromagnetic field being interconnected with one of the one or more wireless communication units, wherein the second antenna is provided between a center axis of the battery and the second end of the hearing aid.

Item 2: A hearing aid according to item 1, comprising a first hearing aid part configured to be positioned in the hearing aid housing behind the ear of a user, a second hearing aid part being configured to be positioned in the ear of a user, and a coupling element coupling the first hearing aid part and the second hearing aid part.

Item 3: A hearing aid according to item 2, wherein the first hearing aid part comprises the battery, and wherein the second hearing aid part comprises a speaker.

Item 4: A hearing aid according to claim 2, wherein the coupling element comprises at least a part of the first antenna.

Item 5: A hearing aid according to any of the preceding items, wherein the second antenna has a longitudinal extension in a second direction.

Item 6: A hearing aid according to item 5, wherein the first antenna (electric) is provided in one or more planes, the one or more planes being orthogonal, such as 90 degrees+/−35 degrees, to the second direction.

Item 7: A hearing aid according to any of the preceding items, wherein the first antenna is configured for radiation in a first frequency range, and the second antenna is configured for radiation in a second frequency range.

Item 8: A hearing aid according to any of the preceding items, wherein the first antenna is an electric antenna and the second antenna is a magnetic antenna.

Item 9: A hearing aid according to any of the preceding items, wherein the first antenna is configured to operate at a frequency above 800 MHz, such as at a frequency above 1 GHz, such as at a frequency of 2.4 GHz, during use.

Item 10: A hearing aid according to any of the preceding items, wherein the second antenna is configured to operate at a frequency below 100 MHz, such as at below 10 MHz, during use.

Item 11: A hearing aid according to any of the preceding items, wherein the second antenna is configured to operate at a frequency between 1 MHz and 100 MHz.

Item 12: A hearing aid according to any of the preceding items, wherein the first antenna is configured for data communication at a first bit rate.

Item 13: A hearing aid according to any of the preceding items, wherein the second antenna is configured for data communication at a second bit rate, the second bit rate being larger than the first bit rate, such as by a factor 10.

Item 14: A binaural hearing aid system comprising a first and a second hearing aid to be provided at a first and a second ear of the user, respectively, wherein one or both of the hearing aids is a hearing aid according to any of items 1-13.

Although particular embodiments have been shown and described, it will be understood that it is not intended to limit the claimed inventions to the preferred embodiments, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid having a hearing aid housing, the hearing aid housing having a first end and a second end, the hearing aid comprising:

a microphone configured to receive an audio signal;

a processing unit configured to process the audio signal for compensating a hearing loss of a user;

a battery in the hearing aid housing;

one or more wireless communication units for wireless communication;

at least a part of a first antenna for electromagnetic field emission and/or electromagnetic field reception, the first antenna coupled with one of the one or more wireless communication units; and a second antenna coupled with one of the one or more wireless communication units, wherein the second antenna is between at least a part of the battery and the second end of the hearing aid housing, wherein the second antenna comprises a magnetic core and an electrical conductor around the magnetic core;

wherein the first antenna has a longitudinal extension in a first direction, and wherein the second antenna has a longitudinal extension in a second direction.

2. The hearing aid according to claim 1, further comprising an earpiece coupled to the hearing aid housing via a cable, wherein the earpiece comprises a receiver and is configured to be at least partially inserted into an ear canal of the user.

3. The hearing aid according to claim 1, wherein the hearing aid housing is a first hearing aid part configured to be positioned behind an ear of the user, and wherein the hearing aid further comprises:

a second hearing aid part configured to be positioned in the ear of the user; and a coupling element coupling the first hearing aid part and the second hearing aid part.

4. The hearing aid according to claim 3, wherein the first hearing aid part comprises the battery, and wherein the second hearing aid part comprises a speaker.

5. The hearing aid according to claim 3, wherein the coupling element comprises at least a part of the first antenna.

6. The hearing aid according to claim 1, wherein the first antenna is provided in one or more planes, the one or more planes forming an angle with the second direction, wherein the angle is in a range of 90 degrees+/−35 degrees.

7. The hearing aid according to claim 1, wherein the first antenna is configured for radiation in a first frequency range, and the second antenna is configured for radiation in a second frequency range.

8. The hearing aid according to claim 1, wherein the first antenna is an electric antenna and the second antenna is a magnetic antenna.

9. The hearing aid according to claim 1, wherein the hearing aid housing has a surface configured to abut against the user of the hearing aid, and wherein the second antenna has a longitudinal axis forming a non-zero angle relative to a plane of the surface.

10. The hearing aid according to claim 9, wherein the longitudinal axis of the second antenna is perpendicular to the plane of the surface.

11. A binaural hearing aid system comprising a first hearing aid and a second hearing aid to be provided at a first ear and a second ear of the user, respectively, wherein one or each of the hearing aids is a hearing aid according to claim 1.

12. The hearing aid according to claim 1, wherein the first antenna is configured to operate at a frequency above 800 MHz.

13. The hearing aid according to claim 1, wherein the second antenna is configured to operate at a frequency below 100 MHz.

14. The hearing aid according to claim 1, wherein the second antenna is configured to operate at a frequency between 1 MHz and 100 MHz.

15. The hearing aid according to claim 1, wherein the first antenna is configured for data communication at a first bit rate, and wherein the second antenna is configured for data communication at a second bit rate, the second bit rate being different from the first bit rate.

16. The hearing aid according to claim 1, wherein the second antenna has an elongated configuration extending in a direction that is parallel to an axis of the battery.

17. The hearing aid according to claim 1, wherein the hearing aid housing has a surface configured to abut against the user of the hearing aid, and wherein the second antenna has a longitudinal axis forming a non-zero angle relative to a plane of the surface.

18. The hearing aid according to claim 1, wherein the first antenna is configured to operate at a frequency of 2.4 GHz.

19. The hearing aid according to claim 1, wherein the first antenna is located closer to a top side of the hearing aid housing than a bottom side of the hearing aid housing.

20. A hearing aid having a hearing aid housing, the hearing aid housing having a first end and a second end, the hearing aid comprising:

a microphone configured to receive an audio signal;

a processing unit configured to process the audio signal for compensating a hearing loss of a user:

a battery in the hearing aid housing;

one or more wireless communication units for wireless communication;

at least a part of a first antenna for electromagnetic field emission and/or electromagnetic field reception, the first antenna coupled with one of the one or more wireless communication units; and a second antenna coupled with one of the one or more wireless communication units, wherein the second antenna is between at least a part of the battery and the second end of the hearing aid housing, wherein the second antenna comprises a magnetic core and an electrical conductor around the magnetic core;

wherein the first antenna is configured to operate at a frequency above 800 MHz.

21. The hearing aid according to claim 20, wherein the first antenna is configured to operate at 2.4 GHz.

22. The hearing aid according to claim 20, further comprising an earpiece coupled to the hearing aid housing via a cable, wherein the earpiece comprises a receiver and is configured to be at least partially inserted into an ear canal of the user.

23. The hearing aid according to claim 20, wherein the hearing aid housing is a first hearing aid part configured to be positioned behind an ear of the user, and wherein the hearing aid further comprises:

a second hearing aid part configured to be positioned in the ear of the user; and a coupling element coupling the first hearing aid part and the second hearing aid part.

24. The hearing aid according to claim 23, wherein the first hearing aid part comprises the battery, and wherein the second hearing aid part comprises a speaker.

25. The hearing aid according to claim 23, wherein the coupling element comprises at least a part of the first antenna.

26. The hearing aid according to claim 20, wherein the second antenna is configured to operate at a frequency below 100 MHz.

27. The hearing aid according to claim 20, wherein the second antenna is configured to operate at a frequency between 1 MHz and 100 MHz.

28. The hearing aid according to claim 20, wherein the first antenna is configured for data communication at a first bit rate, and wherein the second antenna is configured for data communication at a second bit rate, the second bit rate being different from the first bit rate.

29. The hearing aid according to claim 20, wherein the second antenna has an elongated configuration extending in a direction that is parallel to an axis of the battery.

30. The hearing aid according to claim 20, wherein the hearing aid housing has a surface configured to abut against the user of the hearing aid, and wherein the second antenna has a longitudinal axis forming a non-zero angle relative to a plane of the surface.

31. The hearing aid according to claim 20, wherein the first antenna is located closer to a top side of the hearing aid housing than a bottom side of the hearing aid housing.

32. A hearing aid having a hearing aid housing, the hearing aid housing having a first end and a second end, the hearing aid comprising:

a microphone configured to receive an audio signal;

a processing unit configured to process the audio signal for compensating a hearing loss of a user;

a battery in the hearing aid housing;

one or more wireless communication units for wireless communication;

at least a part of a first antenna for electromagnetic field emission and/or electromagnetic field reception, the first antenna coupled with one of the one or more wireless communication units; and a second antenna coupled with one of the one or more wireless communication units, wherein the second antenna is between at least a part of the battery and the second end of the hearing aid housing, wherein the second antenna comprises a magnetic core and an electrical conductor around the magnetic core;

wherein the second antenna is configured to operate at a frequency below 100 MHz.

33. The hearing aid according to claim 32, wherein the second antenna is configured to operate between 1 MHz and 100 MHz.

34. The hearing aid according to claim 32, further comprising an earpiece coupled to the hearing aid housing via a cable, wherein the earpiece comprises a receiver and is configured to be at least partially inserted into an ear canal of the user.

35. The hearing aid according to claim 32, wherein the hearing aid housing is a first hearing aid part configured to be positioned behind an ear of the user, and wherein the hearing aid further comprises:

a second hearing aid part configured to be positioned in the ear of the user; and a coupling element coupling the first hearing aid part and the second hearing aid part.

36. The hearing aid according to claim 35, wherein the first hearing aid part comprises the battery, and wherein the second hearing aid part comprises a speaker.

37. The hearing aid according to claim 35, wherein the coupling element comprises at least a part of the first antenna.

38. The hearing aid according to claim 32, wherein the first antenna is configured for data communication at a first bit rate, and wherein the second antenna is configured for data communication at a second bit rate, the second bit rate being different from the first bit rate.

39. The hearing aid according to claim 32, wherein the second antenna has an elongated configuration extending in a direction that is parallel to an axis of the battery.

40. The hearing aid according to claim 32, wherein the hearing aid housing has a surface configured to abut against the user of the hearing aid, and wherein the second antenna has a longitudinal axis forming a non-zero angle relative to a plane of the surface.

41. The hearing aid according to claim 32, wherein the first antenna is located closer to a top side of the hearing aid housing than a bottom side of the hearing aid housing.

42. The hearing aid according to claim 32, wherein the first antenna is configured to operate at a frequency of 2.4 GHz.

43. A hearing aid having a hearing aid housing, the hearing aid housing having a first end and a second end, the hearing aid comprising:

a microphone configured to receive an audio signal;

a processing unit configured to process the audio signal for compensating a hearing loss of a user;

a battery in the hearing aid housing;

one or more wireless communication units for wireless communication;

at least a part of a first antenna for electromagnetic field emission and/or electromagnetic field reception, the first antenna coupled with one of the one or more wireless communication units; and a second antenna coupled with one of the one or more wireless communication units, wherein the second antenna is between at least a part of the battery and the second end of the hearing aid housing, wherein the second antenna comprises a magnetic core and an electrical conductor around the magnetic core;

wherein the first antenna is configured for data communication at a first bit rate.

44. The hearing aid according to claim 43, wherein the second antenna is configured for data communication at a second bit rate, the second bit rate being larger than the first bit rate.

45. The hearing aid according to claim 43, wherein the second antenna is configured for data communication at a second bit rate, the second bit rate being larger than the first bit rate by a factor of at least 10.

46. The hearing aid according to claim 43, further comprising an earpiece coupled to the hearing aid housing via a cable, wherein the earpiece comprises a receiver and is configured to be at least partially inserted into an ear canal of the user.

47. The hearing aid according to claim 43, wherein the hearing aid housing is a first hearing aid part configured to be positioned behind an ear of the user, and wherein the hearing aid further comprises:

a second hearing aid part configured to be positioned in the ear of the user; and a coupling element coupling the first hearing aid part and the second hearing aid part.

48. The hearing aid according to claim 47, wherein the first hearing aid part comprises the battery, and wherein the second hearing aid part comprises a speaker.

49. The hearing aid according to claim 47, wherein the coupling element comprises at least a part of the first antenna.

50. The hearing aid according to claim 43, wherein the second antenna is configured to operate at a frequency below 100 MHz.

51. The hearing aid according to claim 43, wherein the second antenna is configured to operate at a frequency between 1 MHz and 100 MHz.

52. The hearing aid according to claim 43, wherein the first antenna is configured to operate at a frequency above 800 MHz.

53. The hearing aid according to claim 43, wherein the first antenna is configured to operate at a frequency of 2.4 GHz.

54. The hearing aid according to claim 43, wherein the second antenna has an elongated configuration extending in a direction that is parallel to an axis of the battery.

55. The hearing aid according to claim 43, wherein the hearing aid housing has a surface configured to abut against the user of the hearing aid, and wherein the second antenna has a longitudinal axis forming a non-zero angle relative to a plane of the surface.

56. The hearing aid according to claim 43, wherein the first antenna is located closer to a top side of the hearing aid housing than a bottom side of the hearing aid housing.

57. A hearing aid having a hearing aid housing, the hearing aid housing having a first end and a second end, the hearing aid comprising:

a microphone configured to receive an audio signal;

a processing unit configured to process the audio signal for compensating a hearing loss of a user;

a battery in the hearing aid housing;

one or more wireless communication units for wireless communication;

at least a part of a first antenna for electromagnetic field emission and/or electromagnetic field reception, the first antenna coupled with one of the one or more wireless communication units; and a second antenna coupled with one of the one or more wireless communication units, wherein the second antenna is between at least a part of the battery and the second end of the hearing aid housing, wherein the second antenna comprises a magnetic core and an electrical conductor around the magnetic core;

wherein the second antenna has an elongated configuration extending in a direction that is parallel to an axis of the battery.

58. A hearing aid having a hearing aid housing, the hearing aid housing having a first end and a second end, the hearing aid comprising:

a microphone configured to receive an audio signal;

a processing unit configured to process the audio signal for compensating a hearing loss of a user;

a battery in the hearing aid housing;

one or more wireless communication units for wireless communication;

at least a part of a first antenna for electromagnetic field emission and/or electromagnetic field reception, the first antenna coupled with one of the one or more wireless communication units; and a second antenna coupled with one of the one or more wireless communication units, wherein the second antenna is between at least a part of the battery and the second end of the hearing aid housing, wherein the second antenna comprises a magnetic core and an electrical conductor around the magnetic core;

wherein the first antenna is located closer to a top side of the hearing aid housing than a bottom side of the hearing aid housing.

59. A hearing aid having a hearing aid housing, the hearing aid housing having a first end and a second end, the hearing aid comprising:

a microphone configured to receive an audio signal;

a processing unit configured to process the audio signal for compensating a hearing loss of a user;

a battery in the hearing aid housing;

one or more wireless communication units for wireless communication;

at least a part of a first antenna for electromagnetic field emission and/or electromagnetic field reception, the first antenna coupled with one of the one or more wireless communication units;

a second antenna coupled with one of the one or more wireless communication units, wherein the second antenna is between at least a part of the battery and the second end of the hearing aid housing; and an earpiece coupled to the hearing aid housing via a cable, wherein the earpiece comprises a receiver and is configured to be at least partially inserted into an ear canal of the user;

wherein the first antenna has a longitudinal extension in a first direction, and wherein the second antenna has a longitudinal extension in a second direction.

60. The hearing aid according to claim 59, wherein the second antenna comprises a magnetic antenna.

61. The hearing aid according to claim 59, wherein the hearing aid housing is configured to be positioned behind an ear of the user.

62. The hearing aid according to claim 59, wherein a center of the battery is closer to the second end of the hearing aid housing than to the first end of the hearing aid housing.

63. The hearing aid according to claim 59, wherein the cable comprises at least a part of the first antenna.

64. The hearing aid according to claim 59, wherein the first antenna is provided in one or more planes, the one or more planes forming an angle with the second direction, wherein the angle is in a range of 90 degrees+/−35 degrees.

65. The hearing aid according to claim 59, wherein the first antenna is configured for radiation in a first frequency range, and the second antenna is configured for radiation in a second frequency range.

66. The hearing aid according to claim 59, wherein the hearing aid housing has a surface configured to abut against the user of the hearing aid, and wherein the second antenna has a longitudinal axis forming a non-zero angle relative to a plane of the surface.

67. The hearing aid according to claim 66, wherein the longitudinal axis of the second antenna is perpendicular to the plane of the surface.

68. The hearing aid according to claim 59, wherein the first antenna is located closer to a top side of the hearing aid housing than a bottom side of the hearing aid housing.

69. A binaural hearing aid system comprising a first hearing aid and a second hearing aid to be provided at a first ear and a second ear of the user, respectively, wherein one or each of the hearing aids is a hearing aid according to claim 59.

70. The hearing aid according to claim 59, wherein the first antenna is configured to operate at a frequency above 800 MHz.

71. The hearing aid according to claim 59, wherein the second antenna is configured to operate at a frequency below 100 MHz.

72. The hearing aid according to claim 59, wherein the second antenna is configured to operate at a frequency between 1 MHz and 100 MHz.

73. The hearing aid according to claim 59, wherein the first antenna is configured for data communication at a first bit rate, and wherein the second antenna is configured for data communication at a second bit rate, the second bit rate being different from the first bit rate.

74. The hearing aid according to claim 59, wherein the second antenna has an elongated configuration extending in a direction that is parallel to an axis of the battery.

75. The hearing aid according to claim 59, wherein the first antenna is configured to operate at a frequency of 2.4 GHz.

76. A hearing aid having a hearing aid housing, the hearing aid housing having a first end and a second end, the hearing aid comprising:

a microphone configured to receive an audio signal;

a processing unit configured to process the audio signal for compensating a hearing loss of a user;

a battery in the hearing aid housing;

one or more wireless communication units for wireless communication;

at least a part of a first antenna for electromagnetic field emission and/or electromagnetic field reception, the first antenna coupled with one of the one or more wireless communication units;

a second antenna coupled with one of the one or more wireless communication units, wherein the second antenna is between at least a part of the battery and the second end of the hearing aid housing; and an earpiece coupled to the hearing aid housing via a cable, wherein the earpiece comprises a receiver and is configured to be at least partially inserted into an ear canal of the user;

wherein the first antenna is an electric antenna and the second antenna is a magnetic antenna.

77. A hearing aid having a hearing aid housing, the hearing aid housing having a first end and a second end, the hearing aid comprising:

a microphone configured to receive an audio signal;

a processing unit configured to process the audio signal for compensating a hearing loss of a user;

a battery in the hearing aid housing;

one or more wireless communication units for wireless communication;

at least a part of a first antenna for electromagnetic field emission and/or electromagnetic field reception, the first antenna coupled with one of the one or more wireless communication units;

a second antenna coupled with one of the one or more wireless communication units, wherein the second antenna is between at least a part of the battery and the second end of the hearing aid housing; and an earpiece coupled to the hearing aid housing via a cable, wherein the earpiece comprises a receiver and is configured to be at least partially inserted into an ear canal of the user;

wherein the first antenna is configured to operate at a frequency above 800 MHz.

78. The hearing aid according to claim 77, wherein the first antenna is configured to operate at 2.4 GHz.

79. The hearing aid according to claim 77, wherein the second antenna is configured to operate at a frequency below 100 MHz.

80. The hearing aid according to claim 77, wherein the second antenna is configured to operate at a frequency between 1 MHz and 100 MHz.

81. The hearing aid according to claim 77, wherein the first antenna is configured for data communication at a first bit rate, and wherein the second antenna is configured for data communication at a second bit rate, the second bit rate being different from the first bit rate.

82. The hearing aid according to claim 77, wherein the second antenna has an elongated configuration extending in a direction that is parallel to an axis of the battery.

83. The hearing aid according to claim 77, wherein the hearing aid housing has a surface configured to abut against the user of the hearing aid, and wherein the second antenna has a longitudinal axis forming a non-zero angle relative to a plane of the surface.

84. The hearing aid according to claim 77, wherein the first antenna is located closer to a top side of the hearing aid housing than a bottom side of the hearing aid housing.

85. A hearing aid having a hearing aid housing, the hearing aid housing having a first end and a second end, the hearing aid comprising:

a microphone configured to receive an audio signal;

a processing unit configured to process the audio signal for compensating a hearing loss of a user;

a battery in the hearing aid housing;

one or more wireless communication units for wireless communication;

at least a part of a first antenna for electromagnetic field emission and/or electromagnetic field reception, the first antenna coupled with one of the one or more wireless communication units;

a second antenna coupled with one of the one or more wireless communication units, wherein the second antenna is between at least a part of the battery and the second end of the hearing aid housing; and an earpiece coupled to the hearing aid housing via a cable, wherein the earpiece comprises a receiver and is configured to be at least partially inserted into an ear canal of the user;

wherein the second antenna is configured to operate at a frequency below 100 MHz.

86. The hearing aid according to claim 85, wherein the second antenna is configured to operate between 1 MHz and 100 MHz.

87. The hearing aid according to claim 85, wherein the first antenna is configured for data communication at a first bit rate, and wherein the second antenna is configured for data communication at a second bit rate, the second bit rate being different from the first bit rate.

88. The hearing aid according to claim 85, wherein the second antenna has an elongated configuration extending in a direction that is parallel to an axis of the battery.

89. The hearing aid according to claim 85, wherein the hearing aid housing has a surface configured to abut against the user of the hearing aid, and wherein the second antenna has a longitudinal axis forming a non-zero angle relative to a plane of the surface.

90. The hearing aid according to claim 85, wherein the first antenna is located closer to a top side of the hearing aid housing than a bottom side of the hearing aid housing.

91. The hearing aid according to claim 85, wherein the first antenna is configured to operate at a frequency of 2.4 GHz.

92. A hearing aid having a hearing aid housing, the hearing aid housing having a first end and a second end, the hearing aid comprising:

a microphone configured to receive an audio signal;

a processing unit configured to process the audio signal for compensating a hearing loss of a user;

a battery in the hearing aid housing;

one or more wireless communication units for wireless communication;

at least a part of a first antenna for electromagnetic field emission and/or electromagnetic field reception, the first antenna coupled with one of the one or more wireless communication units;

a second antenna coupled with one of the one or more wireless communication units, wherein the second antenna is between at least a part of the battery and the second end of the hearing aid housing; and an earpiece coupled to the hearing aid housing via a cable, wherein the earpiece comprises a receiver and is configured to be at least partially inserted into an ear canal of the user;

wherein the first antenna is configured for data communication at a first bit rate.

93. The hearing aid according to claim 92, wherein the second antenna is configured for data communication at a second bit rate, the second bit rate being larger than the first bit rate.

94. The hearing aid according to claim 92, wherein the second antenna is configured for data communication at a second bit rate, the second bit rate being larger than the first bit rate by a factor of at least 10.

95. The hearing aid according to claim 92, wherein the second antenna is configured to operate at a frequency below 100 MHz.

96. The hearing aid according to claim 92, wherein the second antenna is configured to operate at a frequency between 1 MHz and 100 MHz.

97. The hearing aid according to claim 92, wherein the first antenna is configured to operate at a frequency above 800 MHz.

98. The hearing aid according to claim 92, wherein the first antenna is configured to operate at a frequency of 2.4 GHz.

99. The hearing aid according to claim 92, wherein the second antenna has an elongated configuration extending in a direction that is parallel to an axis of the battery.

100. The hearing aid according to claim 92, wherein the hearing aid housing has a surface configured to abut against the user of the hearing aid, and wherein the second antenna has a longitudinal axis forming a non-zero angle relative to a plane of the surface.

101. The hearing aid according to claim 92, wherein the first antenna is located closer to a top side of the hearing aid housing than a bottom side of the hearing aid housing.

102. A hearing aid having a hearing aid housing, the hearing aid housing having a first end and a second end, the hearing aid comprising:

a microphone configured to receive an audio signal;

a processing unit configured to process the audio signal for compensating a hearing loss of a user;

a battery in the hearing aid housing;

one or more wireless communication units for wireless communication;

at least a part of a first antenna for electromagnetic field emission and/or electromagnetic field reception, the first antenna coupled with one of the one or more wireless communication units;

a second antenna coupled with one of the one or more wireless communication units, wherein the second antenna is between at least a part of the battery and the second end of the hearing aid housing; and an earpiece coupled to the hearing aid housing via a cable, wherein the earpiece comprises a receiver and is configured to be at least partially inserted into an ear canal of the user;

wherein the second antenna has an elongated configuration extending in a direction that is parallel to an axis of the battery.

* * * * *